US005471192A

United States Patent [19]

Dash

[11] Patent Number: 5,471,192

[45] Date of Patent: Nov. 28, 1995

[54] SOUND PRODUCING DEVICE STIMULATED BY PETTING

[76] Inventor: Glen Dash, 968 Lowell Rd., Concord, Mass. 01742

[21] Appl. No.: 186,014

[22] Filed: Jan. 24, 1994

[51] Int. Cl.[6] ..... G08B 3/00

[52] U.S. Cl. ..... 340/384.3; 340/384.6; 446/176

[58] Field of Search ..... 340/689, 691, 340/692, 693, 384.3, 665, 323 R, 568, 571; 446/183, 184, 297, 298, 486, 302, 175, 353

[56] References Cited

U.S. PATENT DOCUMENTS

| | | | |
|---|---|---|---|
| 3,936,735 | 2/1976 | deBough | 324/664 |
| 4,213,121 | 7/1980 | Learn et al. | 340/384.3 |
| 4,304,126 | 12/1981 | Yelke | 73/119 A |
| 4,314,423 | 2/1982 | Lipsitz et al. | 340/384.3 |
| 4,413,202 | 11/1983 | Krempl et al. | 310/338 |
| 4,479,412 | 10/1984 | Klynas | 84/730 |
| 4,536,164 | 8/1985 | Klawitter | 446/143 |
| 4,600,855 | 7/1986 | Strachan | 310/321 |
| 4,637,007 | 1/1987 | Sakurai | 369/67 |
| 4,794,295 | 12/1988 | Penneck et al. | 310/338 |
| 4,936,809 | 6/1990 | Auer et al. | 446/184 |
| 4,990,897 | 2/1991 | Beyma et al. | 340/665 |
| 5,130,693 | 7/1992 | Gigandet | 340/384.3 |
| 5,153,566 | 10/1992 | Yun | 340/689 |
| 5,195,920 | 3/1993 | Collier | 446/409 |
| 5,210,528 | 5/1993 | Schulman et al. | 340/692 |
| 5,221,225 | 6/1993 | Newbold et al. | 446/297 |
| 5,264,824 | 11/1993 | Hour | 340/665 |
| 5,281,180 | 1/1994 | Lam et al. | 446/297 |
| 5,324,225 | 6/1994 | Satoh et al. | 446/353 |

FOREIGN PATENT DOCUMENTS

| | | | |
|---|---|---|---|
| 0751228 | 6/1956 | United Kingdom | 446/184 |

OTHER PUBLICATIONS

"Lookout" People Magazine, p. 20, Mar. 21, 1977.

*Primary Examiner*—John K. Peng
*Assistant Examiner*—Benjamin C. Lee

[57] ABSTRACT

A fanciful animal (12) which emits a purring sound when petted. A sensor, comprising an enclosure of a fanciful animal (18), pressure transducer (14) and cushion material (16) is arranged so as to permit at least a portion of said cushioning material to move freely over said pressure transducer when said enclosure is rubbed, producing an output signal of sufficient magnitude to be detected by an electronics assembly (20). The electronics assembly produces a waveform of predetermined form which when applied to a speaker (SP1) simulates a purr.

6 Claims, 6 Drawing Sheets

SOUND PRODUCING DEVICE STIMULATED BY PETTING

BACKGROUND—FIELD OF INVENTION

This invention relates to devices which produce sound effects when stimulated by movement across their surfaces, and specifically to a device which produces a simulated purr when petted.

BACKGROUND—DESCRIPTION OF THE PRIOR ART

Electronic amusement devices, such as toys or dolls which generate sound effects when stimulated manually have been popular for many years. The enduring appetite of the marketplace for such toys is testament to their utility as a form of entertainment. Such devices can generate sophisticated sound effects such as simulated speech, music, animal and mechanical sounds. Generally these devices require the use of some form of mechanical switch to stimulate the electronic production of sound. In most cases, the switch is mounted on or near the outside surface of the product and is activated by the user consciously seeking out and activating the switch mechanism.

One form of such an amusement device is a plush toy in the form of a fanciful animal that emits a comforting purring sound when petted. Such toys have been proposed for more than fifteen years (People Magazine, Mar. 21, 1977, page 20). A number of features set such toys apart. The toy itself is comforting. Few sounds in the animal world have the tranquilizing effect of the purr of a cat. Such toys are appealing to three separate senses: the image of a toy itself can be appealing to sight, the sound it emits is comforting to the ear, and it purrs in response to the user's touch. Such toys yield the illusion of life within an inanimate object.

Creating the illusion of life within an otherwise inanimate object has proven to be most difficult. It is simply not sufficient nor desirable to have the toy respond to the throwing or pressing of a switch. The feel of a living animal responding to a special form of touch is lost when such starkly mechanical means are used.

Giving the illusion of life to an otherwise inanimate object is possible, in part, by making a fanciful animal which responds to a delicate movement across its surface. In this form a touch, of just the right kind, must be applied for the animal to respond, just as one would use to get a living feline (cat or kitten) to respond. Rub it just in the right place and the animal seems to relax and begins to purr.

Producing such toys has, in practice, been quite difficult. Conventional switches often require more pressure to activate than can be accommodated through a light touch. Special switches can be designed to detect light touches, but they become impractical to use. The impracticality stems from the fact that traditional switches do not distinguish between dynamic and static forces. Petting is a variable (dynamic) force whereas the skin or enclosure of the toy exerts a static force on any switch confined inside. In order for a switch to work, its moving contact has to be mechanically coupled to the skin. Doing so, however, exerts a significant static force on the switch, often closing its contacts permanently. In other words, to get a very sensitive mechanical switch to work often requires tight coupling to the skin of the toy, but such tight coupling itself can act to keep the switch permanently locked in one position. As pointed out by Yun in U.S. Pat. No. 5,153,566, issued Oct. 6, 1992, such devices have proven unreliable.

Further, as pointed out above, switches of the mechanical type are often mounted close to the skin of the toy in order to function. In this position, they can be felt. The user, when feeling the switch, can have the illusion of live animal evaporate. The feel of mechanics inside remind children and adults alike that the object of their affection is a machine.

Yun proposed a different kind of mechanical switch. The Yun device is a sensor in which a metal ball is positioned within a housing, one side of which contains rows of alternately connected electrically conductive fingers. As the sensor is moved or tipped, the ball rolls along these fingers alternately making and breaking contact between them. Electronic circuitry detects the making and breaking of contact and generates a sound output in response. Yun claims such device is sensitive enough to detect stroking when mounted with a plush toy.

The practicality of the Yun device in a toy designed to respond to stroking, rubbing or petting is not known. However, a device such as Yun's would respond to far more input than just stroking, rubbing or petting. It would respond to tilting and to movement as well. It would respond to shaking and rotation. All these unwanted effects would serve to undermine the illusion of the fanciful cat or other animal as a living thing, and which, like a real animal, was responsive to just the right kind of touch from its owner. Furthermore, such a sensor has to be mounted upright; when inverted it loses all sensitivity. This can be an important disadvantage when it is considered that such toys must be manufactured quickly and in great quantity.

The Yun sensor also suffers from other marked deficiencies that render it a questionable choice for use in such a toy. For one, its sensitivity cannot be readily adjusted. It is fixed by the design of the device and cannot be changed except through retooling. Further, the output of the Yun device is non linear. It can only signal its state as on or off. It cannot generate an output proportional to the strength of applied petting.

A sensor which overcame these difficulties could open the way for a new line of amusement devices that seemed to respond to the touch in a realistic and lifelike fashion. Such a device can serve as a source for amusement of children and adults alike. Further, it could have therapeutic effects on the aged, infirm or merely lonely.

OBJECTS AND ADVANTAGES

In addition to the objects and advantages of the sensors described above, the objects of the present invention are as follows:

1. To provide for an inexpensive, reliable sensor to be built into a toy or doll to detect motion across the toy's surface, such as stroking, rubbing or petting.

2. To provide a sensor that can distinguish between static and dynamic loads.

3. To provide for a sensor sensitive to petting, stroking or rubbing or other movement across its surface or the surface of the device it is contained within and which can be made relatively immune to tilting, transport, rotation or inversion and which can be mounted in any position relative to the horizon.

4. To provide for a sensor whose sensitivity can be easily adjusted.

5. To provide for a sensor whose output is proportional to the force applied to it.

6. To provide for a sensor which is relatively immune to ambient sounds, or light or other forms of electromagnetic energy.

7. To provide for a sensor which can be mounted within a plush toy so as not to be felt near the surface and so as to enhance its immunity to sound or light.

8. To provide for an electronic mechanism which can be triggered by the output of such a sensor and electronically generate sound in response, varying the output in response to the motion across the surface of a toy and being continuously retriggered by continuing motion.

9. To provide for the electronic generation of a realistic purring sound.

Still further objects and advantages will become apparent from a consideration of the ensuing descriptions and drawings.

BRIEF DESCRIPTION OF THE DRAWINGS

A further understanding of this invention is presented by reference to the following detailed description read in conjunction with the accompanying drawings.

List of Reference Numerals in Drawings

Figure 1:
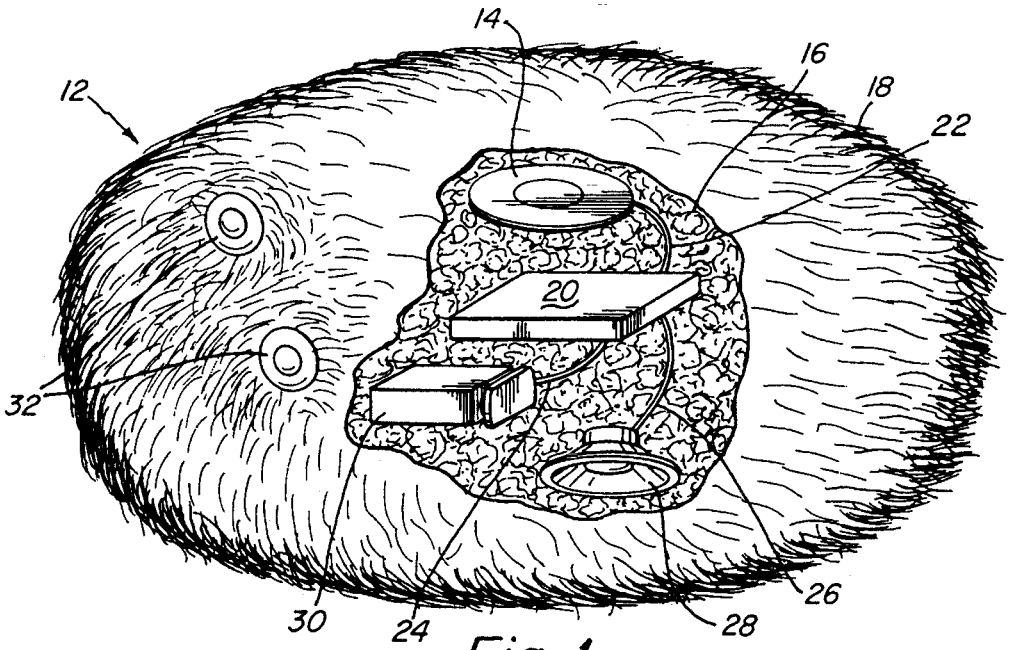
FIG. 1 is a cut away perspective view of a fanciful furry animal with two eyes on the exterior, the cut away exposing the interior which is filled with a cushioning material which cushions, contacts and separates various electronic and mechanical components.

| | |
|---|---|
| 12 | Fanciful Animal |
| 14 | Pressure Transducer |
| 16 | Cushioning Material |
| 18 | Enclosure |
| 20 | Electronics Assembly |
| 22 | Wires |

-continued

List of Reference Numerals in Drawings

| | |
|---|---|
| 24 | Wires |
| 26 | Wires |
| 28 | Output Sound Transducer |
| 30 | Battery |
| 32 | Eyes |
| 34 | Simulated Cat |
| 36 | Pressure Transducer |
| 38 | Cushioning Material |
| 39 | Wires |
| 40 | Enclosure |
| 41 | Wires |
| 42 | Output Transducer |
| 43 | Wires |
| 44 | Electronics Assembly |
| 46 | Battery |
| 48 | Petting Detector |
| 50 | Amplifier/Signal Processor |
| 52 | Threshold Detector |
| 54 | Time Delay |
| 56 | Sound Generator |
| 58 | Amplifier |
| 60 | Output Sound Transducer |
| 62 | Petting Detector |
| 64 | Amplifier/Signal Processor |
| 66 | Threshold Detector |
| 68 | Time Delay |
| 70 | Sound Generator |
| 72 | Voltage or Current Controller Attenuator |
| 74 | Amplifier |
| 78 | Petting Detector |
| 80 | Amplifier/Signal Processor |
| 82 | Threshold Detector |
| 84 | Time Delay |
| 86 | Sound Generator |
| 88 | Amplifier |
| 90 | Voltage or Current Controller Attenuator |
| 92 | Sound Transducer |
| 94 | Waveform |
| 96 | CMOS 4011 QUAD NAND Gate |
| 98 | Petting Sensor |
| 99 | Wires |
| 100 | Enclosure |
| 102 | Cushioning Material |
| 104 | Pressure Transducer |
| 106 | Petting Sensor |
| 108 | Wires |
| 110 | Foam Material |
| 112 | Pressure Transducer |
| 114 | Head of a Doll |
| 116 | Pressure Transducer |
| 117 | Wires |
| 118 | Wires |
| 120 | Wires |
| 122 | Electronics Assembly |
| C1–C8 | Capacitors |
| IC1a, IC1b | NAND Gates |
| P1 | Input Transducer |
| Q1, Q2 | MOSFETS |
| Q3–Q8 | Transistors |
| R1–R13 | Resistors |
| SP1 | Speaker |

DETAILED DESCRIPTION FIG. 1 TO 11

FIG. 1 shows a typical embodiment of the present invention. A pillow shaped fanciful animal 12 is shown within an enclosure 18 made of fur or furlike material. Two eyes 32 give the fanciful animal a lifelike appearance. A cutaway exposes the interior of the fanciful animal which is filled with a pliable covering or cushioning material 16 which gives the fanciful animal support and resilience. This cushioning material is mechanically coupled to a pressure transducer 14 output of which passes along wires 22 to the electronics assembly 20.

Electronics assembly 20 is fed power via a battery 30 via wires 24. The electronics assembly detects voltage or current from the pressure transducer and, in response to these inputs produces an electrical signal or resultant which drives output sound transducer 28 via wires 26.

The user of the fanciful animal stimulates it by petting it. Movement across the surface of the fanciful animal causes the enclosure to deflect very slightly. This deflection causes the cushioning material to deflect slightly and this deflection is transmitted throughout the cushioning material, being attenuated as it moves farther away from the source. The cushioning material is in contact with or abuts the pressure transducer and some of the cushioning material moves across the surface of the pressure transducer, or normal to it, in response to the deflection. The pressure transducer responds to the change in pressure on its surface producing an electrical resultant at its output which is detected by the electronics assembly.

A pressure transducer need not be rigidly mounted within the enclosure to any other object such as the electronics assembly for it to detect movement across the surface of the enclosure. The reason for this is that the pressure applied across or normal to the pressure transducer by the movement of the cushioning material will not be uniform across its surface. The surface of the pressure transducer closer to the portion of the surface subject to petting will exhibit relatively more pressure than any other side. For this reason, the pressure transducer will remain relatively fixed while the cushioning material moves across its surface or normal to it.

Many types of pressure transducers could be used such as piezo resistive, piezo ceramic, piezo electric, piezo junction, elastomeric, electrostatic, photoelectric, magnetostrictive, membrane or skin gauge based types. Further, the pressure transducer can be in contact with the cushioning material directly or can be housed in a housing of its own, separating the surface of the pressure transducer from the cushioning material. In this case, movement of the cushioning material across the housing of the pressure transducer creates a sound within the housing. The pressure transducer picks up this sound and produces an output in response.

The pressure transducer can be mounted anywhere in the enclosure. Depending on where it is mounted and on the sensitivity of the electronics assembly, the fanciful animal will appear to have different characteristics in response to petting. Petting closer to the pressure transducer will tend to produce a greater output from the pressure transducer. It is preferred that the pressure transducer not be placed too close to the surface however, for the user may be able to feel its presence. Further, placing the transducer in the body of the fanciful animal makes it less likely to respond to loud sounds such as clapping or shouting in the room. Embedding the pressure transducer within the body of the fanciful animal also prevents the transducer from picking up the sound or vibration produced by the output sound transducer. If the pressure transducer picks up too much sound from the output sound transducer, the fanciful animal, once stimulated, might never turn off. The sound produced by the output sound transducer could be interpreted by the pressure transducer as continued stroking and it could continue to run until the batteries drained.

The batteries can be of any conventional type or could be made rechargeable. They could be permanently mounted within the enclosure of the animal or through a pocket or other such suitable means, can be made removable and replaceable.

The output sound transducer could be of any suitable form, such as a speaker, buzzer or a piezo element.

The cushioning material could be any form of material whose hardness is less than that of the pressure transducer. Material types such as batting commonly used to stuff plush toys are one example. These include natural materials such as cotton or wool or synthetic materials such as polyester, rayon, fiberglass or nylon. Other forms of cushioning material such as foam, plastics and rubber could also be used, as could pellets made out of plastic or foam materials. Woven metal materials such as steel or cotton wool could also be used.

The enclosure or skin is generally made out of a fur or furlike material. Other coverings such as those used for dolls, toys or upholstery including natural or simulated leather or rubber could also be used.

Figure 2:
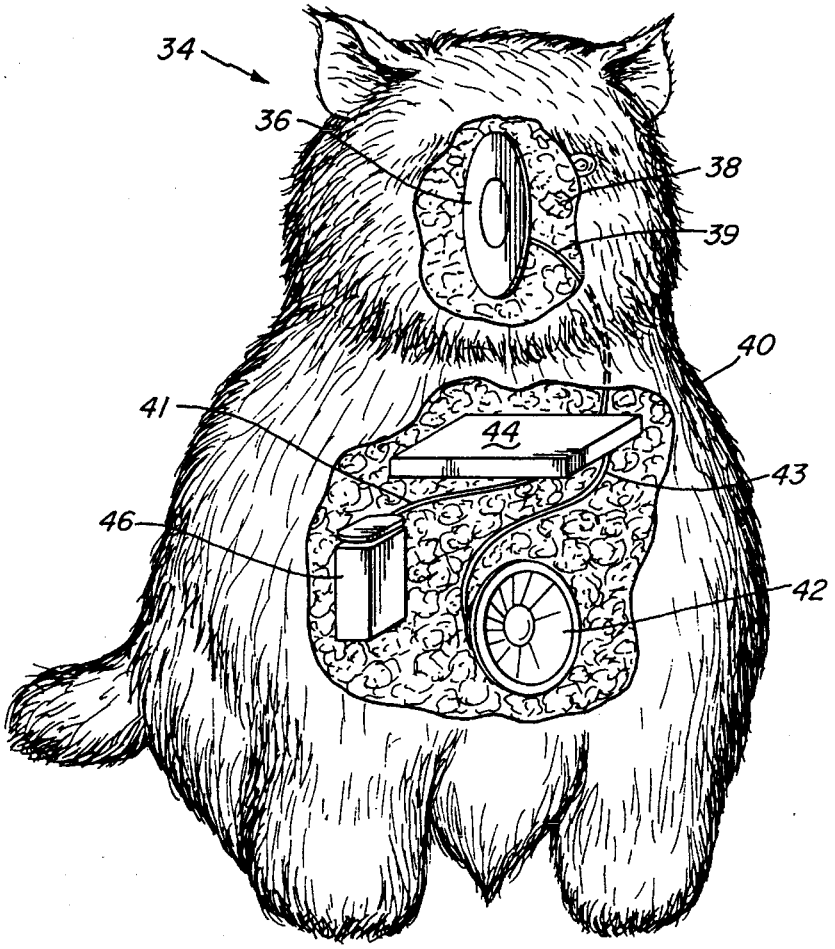
FIG. 2 is a cut away perspective view of a simulated cat, filled with cushioning material, electronic and mechanical parts.

FIG. 2 shows a simulated cat 34. Contained within it and revealed through the cutaway is cushioning material 38 and a pressure transducer 36 which connect via a wires 39 to an electronics assembly 44. Power to assembly is supplied by a battery 46 through a wires 41. Signals to an output sound transducer 42 are supplied via a wires 43.

The forms this invention can take are not limited to actual or fanciful animals. The invention can be incorporated into any form of toy, doll, amusement devices, or articles of furniture, such as pillows, cushions, chairs, or rugs.

Figure 3:
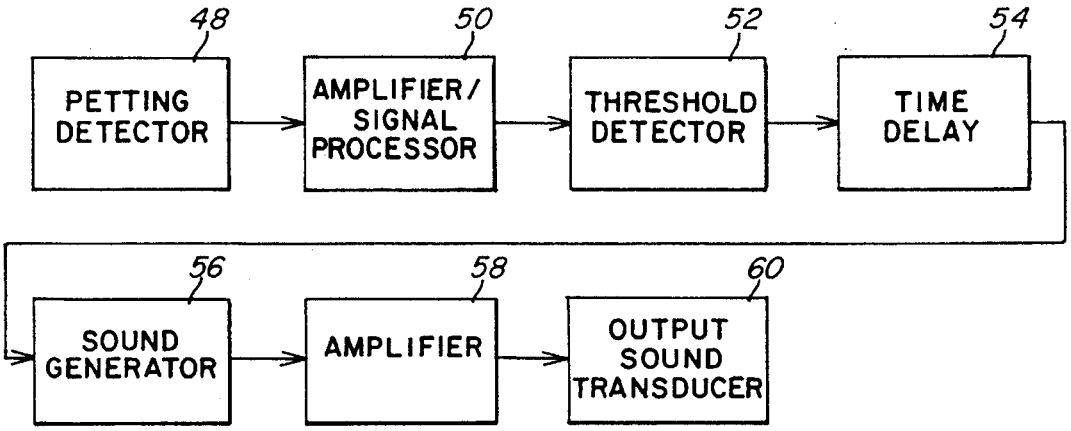
FIG. 3 is a block diagram of an embodiment of the electronic and mechanical parts shown in FIG. 1 and FIG. 2.

FIG. 3 shows a block diagram of one form of the present invention. A petting detector 48 detects the petting, rubbing or stroking occurring on the enclosure of the simulated cat, fanciful animal, or other toy. It produces a signal at its output, in the form of voltages, currents, or changes in impedance, which is received at the input of an amplifying and signal processing stage, amplifier/signal processor 50. This amplifier/signal processor can amplify (multiply) or filter the signal. The amount of amplification needed depends on the sensitivity of the petting detector. The amplifier/signal processor can serve to filter out unwanted frequencies, passing frequencies typically produced by the action of a cushioning material running across or normal to the surface of petting detector 48 in response to motion across the surface. It can also filter out other extraneous signals such as ambient room noise or signals associated with output sound transducer 60. The signal present at the output of the amplifier/signal processor is then passed on to the input of a threshold detector 52 which determines if the form of the signal produced by the amplifier/signal processor is typical of the desired motion on the surface of the toy. The output of the threshold detector is connected to the input of a time delay 54 which serves as a memory device. The time delay is designed to respond to signals from the threshold detector, thereby being "triggered" by it, by producing an output of a particular form at its output terminals. This output is known as the "ON" state. The time delay can be designed to maintain such an "ON" state for a predetermined or programmed length of time so that the toy continues to produce a sound output even when petting ceases. After the predetermined time in the "ON" state, the time delay reverts to its "OFF" state (wherein no sound is produced). In the alternative, the time delay could be designed to maintain the device in an "OFF" state for a predetermined period of time followed by a predetermined "ON" time (wherein sound is produced). Or further, the time delay could be designed or programmed to produce several periods of "ON" and "OFF" times cascaded, triggered by a single output in the proper form produced by the threshold detector.

In the preferred embodiment, the time delay 54 is "retriggerable" meaning that it is responsive to continuing output from the threshold detector even during the time that sound output is being produced by output sound transducer 60. In this way, continuing petting gives rise to continuing output just as occurs with a real animal.

The time delay could also be designed to shut down portions of the circuitry shown in FIG. 3 after a specified period of time of operation to save battery power. It could power up such electronics circuitry in response to renewed petting.

The output of time delay 54 passes from its output terminals to the input terminals of a sound generator 56. This sound generator could be in the form of discrete electronic components, such as transistors or field effect devices, arranged in such a way as to produce an audible output signal. In the alternative, the sound generator could be a mechanical device such as a tape player, record player or music box, could utilize logic circuits, be a timer, an astable circuit, multivibrator, oscillator, microprocessor controlled sound generator, or be a specially designed electronic sound generator designed into an integrated circuit.

The output of the sound generator is connected to the input of an amplifier 58 and amplified (multiplied) to drive an output sound transducer 60 to produce audible sound.

Figure 4A:
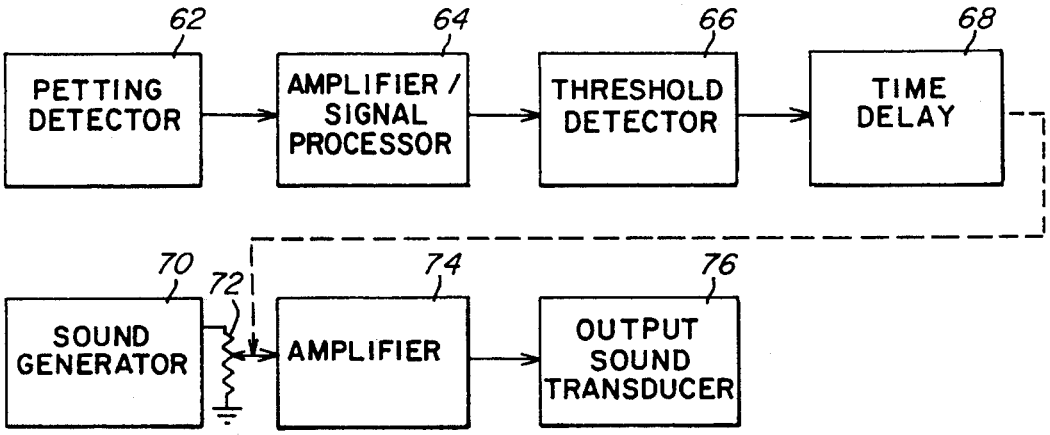
FIG. 4 is an improvement on the block diagram shown in FIG. 3 with FIG. 4*a* representing the preferred embodiment of the present invention and FIG. 4*b* representing an alternate embodiment.

FIG. 4*a* shows an improvement on the basic block diagram shown in FIG. 3. Here a petting detector 62 sends an output signal to an amplifier/signal processor 64 which in turn drives a threshold detector 66. That threshold detector drives a time delay circuit 68. This time delay circuit does not initialize a sound generator in an "on" and "off" logical fashion as shown in FIG. 3, but instead it utilizes a voltage or current controlled attenuator 72 to control the amplitude of signal sent by sound generator 70 to the amplifier 74. This voltage or current controlled amplifier could be implemented using devices whose resistance can be electronically controlled or could be implemented by controlling the power to the sound generated circuit 70. The output signal from the amplifier passes to an output sound transducer 76.

Figure 4B:
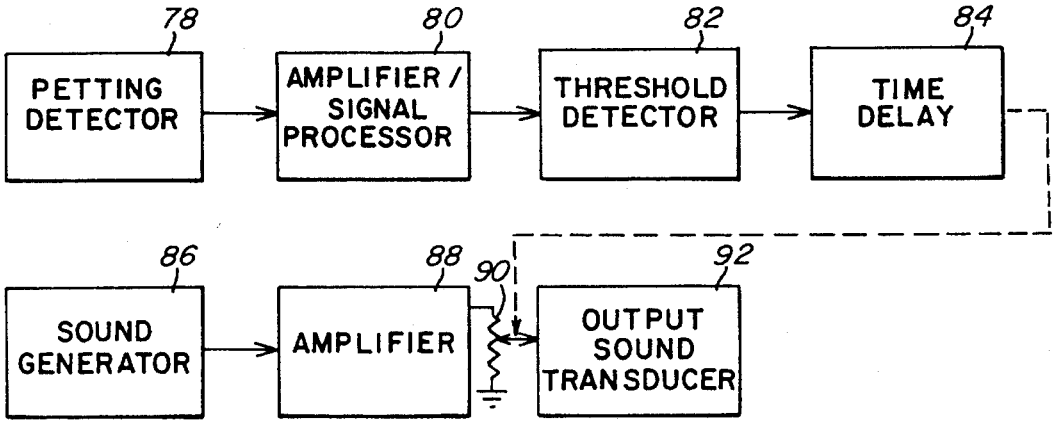

FIG. 4*b* shows an alternate implementation of the present invention. Here a petting detector 78 feeds a signal to an amplifier/signal processor 80 which in turn drives a threshold detector 82 and a time delay circuit 84. The output of the time delay circuit 84 drives a voltage or current controlled attenuator 90 which, in lieu of the connection at the output of the sound generator 76 as shown in FIG. 4*a*, is positioned at the output of amplifier 88 of FIG. 4*b*. Audible output is produced by sound transducer 92.

Figure 5:
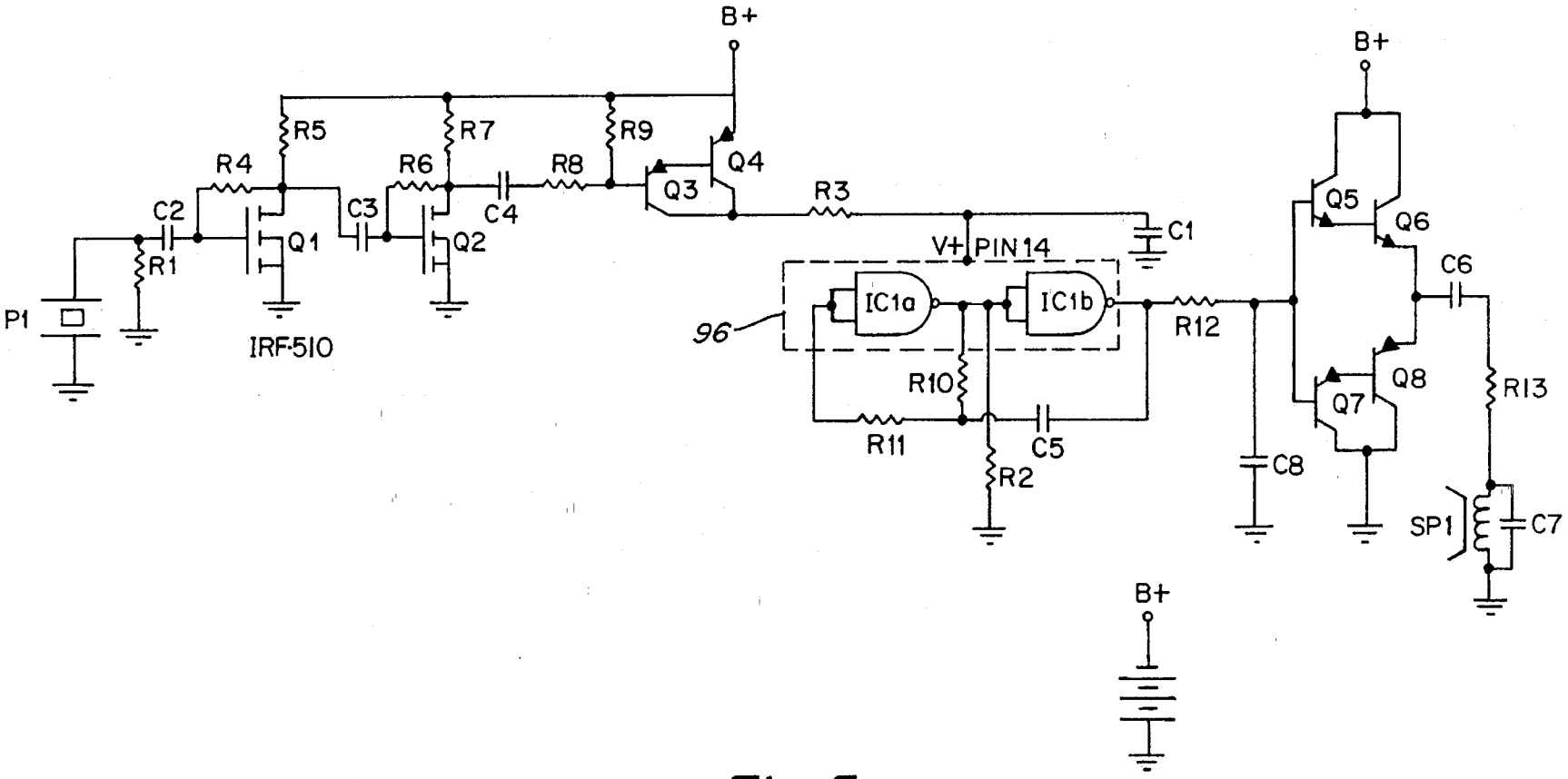
FIG. 5 is the preferred embodiment of the present invention shown in schematic form.

FIG. 5 shows a schematic representation of the preferred embodiment. P1 is an input sound transducer. For this embodiment an Archer Cat. No. 273-091 Piezoelectric Element is used. Input sound transducer P1 has across its terminals a load impedance represented by resistance R1. This load impedance controls the sensitivity of the toy. A smaller resistance would lessen the sensitivity of the toy to movement across its surface. Raising the resistance would increase the sensitivity. Therefore, through R1 the sensitivity of the circuit can be readily controlled.

Capacitor C2 decouples direct current signals from P1 and R1 and in combination with resistor R4 acts as a high pass filter feeding voltages to the input of an amplifying valve, in this case a MOSFET, Q1. Resistor R4 also self-biases MOSFET Q1 by allowing current to flow from the drain of Q1 through to its gate. This causes MOSFET Q1 to enter its active region. This, in turn, causes current to flow through resistor R5, lowering the voltage on the drain of Q1 and hence, lowering the voltage from gate to source on Q1. In the preferred embodiment Q1 is a IRF-510 device. The circuit acts to self-bias an IRF-510 MOSFET at approximately 3 volts.

The MOSFET Q1 acts as a gain element producing a voltage gain of between 10 and 15 from the gate to the drain of Q1. The output signal from the drain of Q1 is connected via capacitor C3 to the gate of Q2 which functions in a similar fashion to Q1. The output from the drain of Q2 is passed through a combination consisting of capacitor C4, resistor R8 and resistor R9 to the base of a transistor Q3. This combination acts as a high pass filter producing a signal at the base of Q3.

The overall gain of the amplification elements consisting of Q1, Q2 and their associated parts is approximately 200.

When the voltage between the base of Q3 and the emitter of Q4 exceeds the forward base to emitter voltage drop (VBE) of transistors Q3 and Q4, shown in a Darlington arrangement, Q3 and Q4 go into their active forward state and as a result supply current to resistor R3 and capacitor C1. Together, transistors Q3 and Q4 act as electronic level detection means.

IC1*a* and IC1*b* are two NAND Gates from a 4011 CMOS quad NAND gate integrated circuit. Capacitor C5 and resistors R10 and R11 are arranged in such a way as to produce an oscillating substantially square wave at the output of IC1*b*. The functioning of this circuit has been described elsewhere (See "CMOS Linear Applications" National Semiconductor Applications Note 88, National Semiconductor Corporation, 2900 Semiconductor Drive, Santa Clara, Calif. 95052). In the alternative, other inverting amplification elements could be used in lieu of IC1*a* and IC1*b* including inverters, NOR Gates, operational amplifiers or amplifiers built with discrete components such as transistors or field effect devices.

As current flowing through R3 charges capacitor C1, the voltage on pin 14 of a CMOS 4011 QUAD NAND Gate 96 device begins to rise. This pin supplies power to the internal elements of IC1*a* and IC1*b*. As this voltage increases past a threshold of approximately 3 volts the portion of the circuit consisting of IC1*a*, IC1*b*, C5, R10, R11 and R2 begins to operate, producing a substantially square wave signal at the output of IC1*b*. The amplitude of this signal tracks the amplitude of the voltage applied to pin 14. The higher the voltage on pin 14, the higher the amplitude of the signal at the output of IC1*b*. The voltage at pin 14 is the time average integration of the voltage applied across R3 and C1.

The time constant consisting of resistor R3 and capacitor C1 is chosen to produce a pleasing increase in the amplitude of the output signal (known as the "attack" of the output signal) as petting or stroking ensues. Resistor R2 in combination with capacitor C1 substantially controls the fall time of the output signal by controlling the voltage at pin 14. As stroking or petting ceases, the toy will continue to produce an output signal which gradually will fade as the voltage at pin 14 falls. The combination produced by R2 and C1 is chosen to produce a pleasing fade (or "decay"). R2 also prevents parasitic oscillations of the NAND gates which can result when pin 14 passes through a threshold voltage of 3 volts.

The output from IC1*b* passes in through a low pass filter consisting of resistor R12 and capacitor C8. The time constant produced by R12 and C8 was chosen to reduce the risetime of the signal produced by IC1*b* in an aesthetically pleasing fashion. This signal is then coupled to the Darlington push/pull pair consisting of transistors Q5, Q6, Q7 and Q8, which in turn drives an output decoupling and filter circuit consisting of capacitor C6 and resistor R13. R13 supplies current to a speaker SP1 which has placed across its terminals a capacitor C7.

Figure 6:
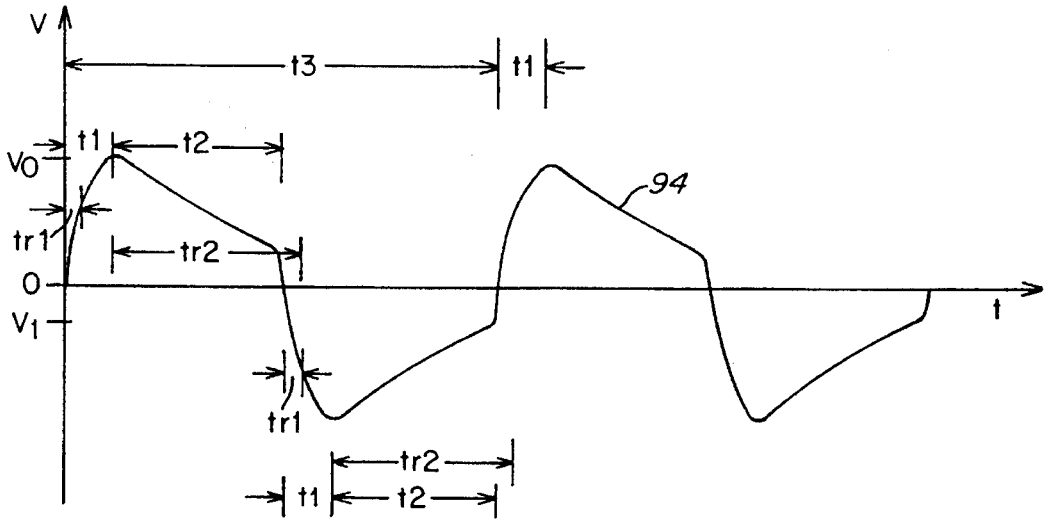
FIG. 6 is a drawing of the voltage waveform impressed across the terminals of the speaker SP1 in FIG. 5.

The output circuit consisting of resistors R12 and R13, capacitors C8, C6, C7 and transistors Q5 through Q8 function to produce a waveform substantially as shown in FIG. 6. This waveform 94 represents the voltage impressed across the speaker SP1 of FIG. 5.

Waveform 94, when impressed across the terminals of a speaker such as the Radio Shack Archer 2¼" miniature replacement speaker catalog no. 40-246, produces a pleasing tone reminiscent of a cat purring. The waveform consists of an asymptotically rising waveform for the period shown as t1 with a risetime tr1, followed by an asymptotically falling waveform for the period shown as t2 and a falltime tr2. This, in turn, is followed by a asymptotically falling waveform of period t1 approximately equal in magnitude to the rising waveform described above and with a falltime approximately equal to tr1. Finally, this is followed by an asymptotically rising waveform of period t2 equal in magnitude to the first falling waveform with a risetime tr2. Waveform 94 repeats periodically with a frequency f1 (equal to 1 divided by the period t3). This frequency f1 typically lies between 5 and 20 Hz. Period t2 and risetime tr1 are typically less than 0.1 second. The amplitude of waveform 94 is shown as Vo.

Figure 7:
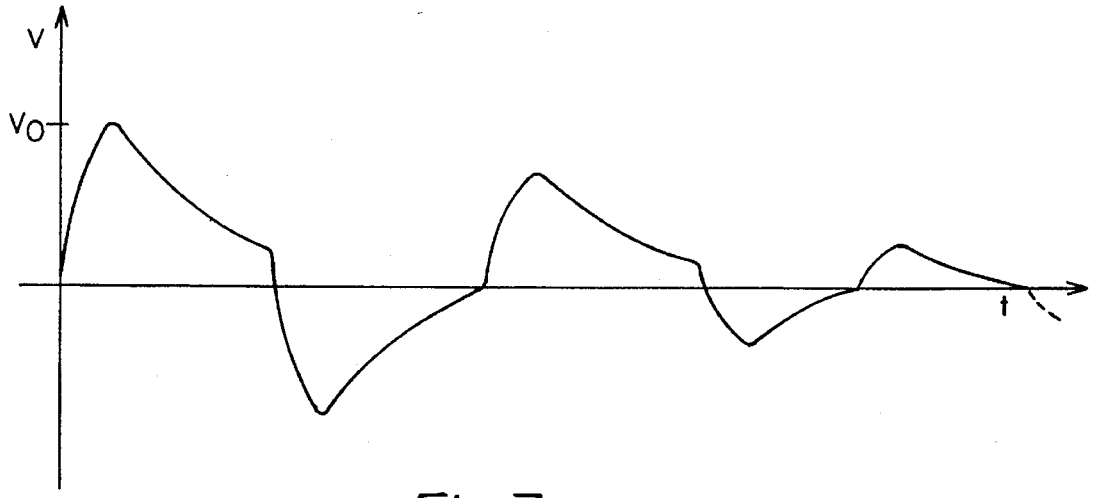
FIG. 7 is the drawing of an alternative voltage waveform, to be impressed across the terminals of the speaker SP1 in FIG. 5.

FIG. 7 shows a waveform which is similar to waveform 94 of FIG. 6 and is intended to be impressed across the terminals of an output sound transducer such as a speaker. In this case, however, the amplitude of each portion of the waveform is reduced by a predetermined amount each cycle. In this manner, the sound appears to fade away. If a new triggering event is detected, then the amplitude increases once again to amplitude Vo, fading once again with each cycle until the sound disappears completely or more petting is detected.

Figure 8:
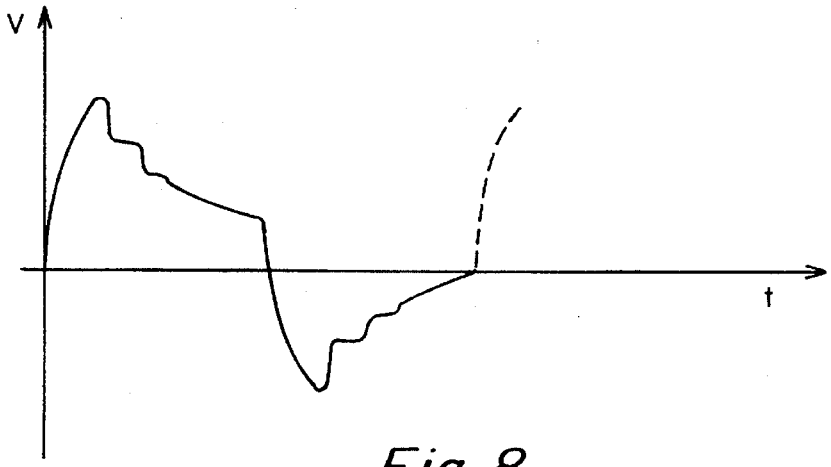
FIG. 8 is the drawing of an alternative voltage waveform to be impressed across the terminals of the speaker SP1 in FIG. 5.

FIG. 8 shows waveform 94 modified with the superimposition of a damped ringing wave. The initial rise time of waveform 94 can cause circuit elements to resonate, producing this ringing. In the alternative, electronic circuitry can be employed to deliberately produce such ringing for special audio effects.

Figure 9A:
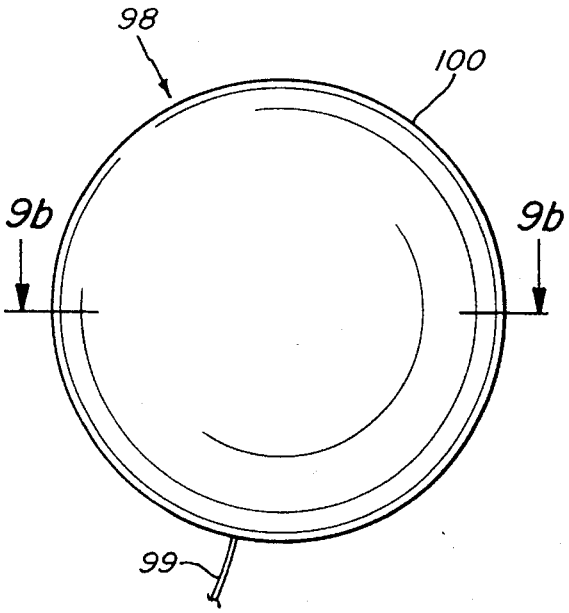
FIG. 9*a* is a perspective view of a petting transducer and FIG. 9*b* is a sectional view of the same transducer taken at the sectional lines shown in FIG. 9*a*.
Figure 9B:
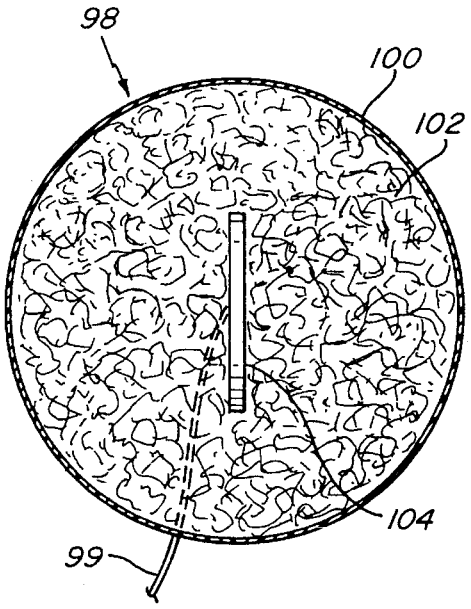

FIG. 9A shows a simplified embodiment of a different sensor, also designed to detect petting. A self-contained petting detector 98 has exiting from its body wires 99. FIG. 9B is a sectional view of FIG. 9A. It shows the interior of petting sensor 98 consisting of a skin or enclosure 100, cushioning material 102, and a pressure transducer 104. When the surface of the enclosure is rubbed, the cushioning material is displaced. The action of the cushioning material across the surface of the pressure transducer, or normal to it, produces an output signal which is carried by the wires to an electronics assembly (not shown).

Figure 10A:
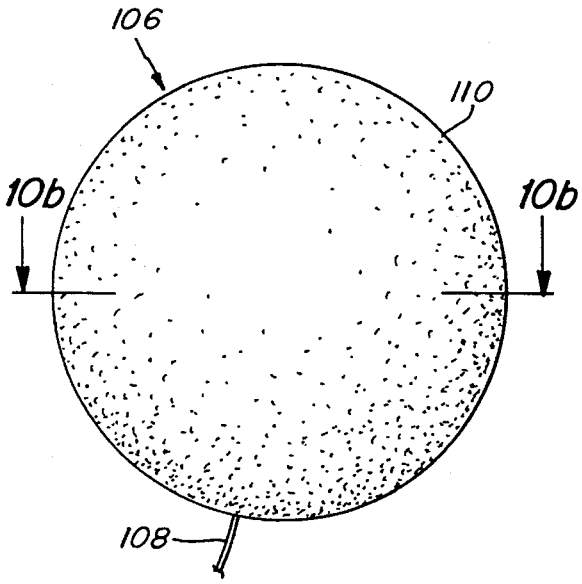
FIG. 10*a* is the perspective view of an alternative embodiment of a petting transducer and FIG. 10*b* is a sectional view of the same transducer taken at the sectional lines shown in FIG. 10*a*.
Figure 10B:
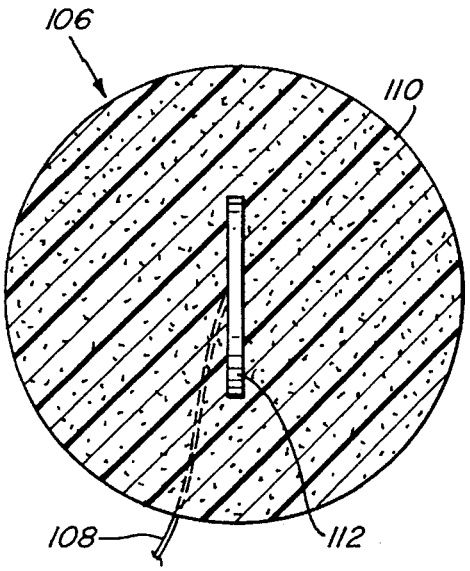

FIG. 10 shows an alternate embodiment of petting sensor 98 of FIG. 9. FIG. 10A shows the petting sensor 106 which consists of a foam or elastomeric ball. Exiting from the ball are wires 108. FIG. 10B is a cross-sectional view of FIG. 10*a* revealing the internal structure of the petting sensor. Here a cushioning material 110 cushions and suspends a pressure transducer 112. The primary difference between the petting sensor of FIG. 10 and that of FIG. 9 is that the sensor of FIG. 10 does not need an enclosure to contain the cushioning material. Rather, the cushioning material is rigid enough to serve as its own enclosure while still pliable enough to transmit movement across its surface to the pressure transducer. Foam rubber is an example of one type of material which could be used to make the pressure transducer of FIG. 10.

Figure 11:
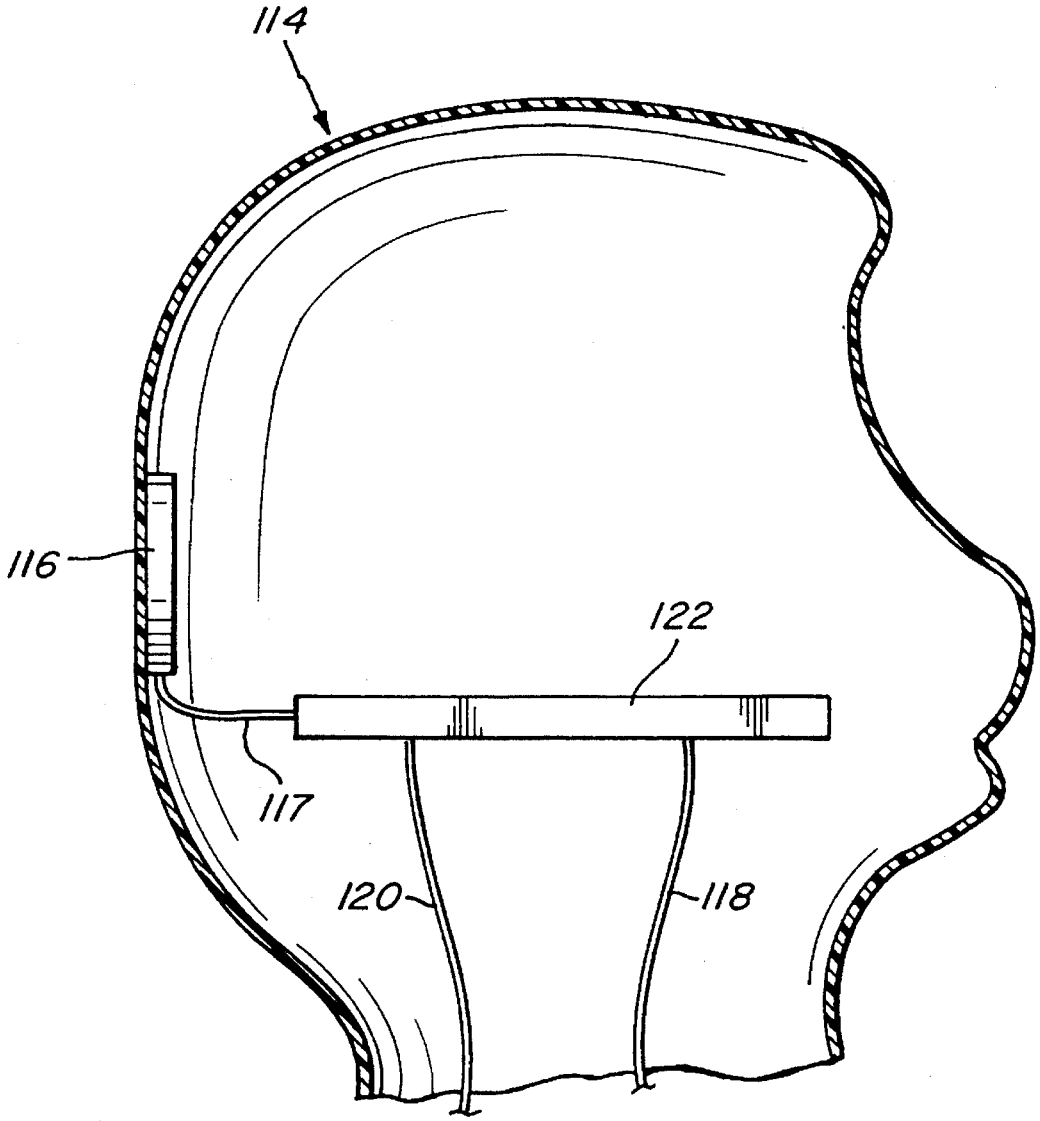
FIG. 11 is a cross sectional view of a doll's head exposing interior parts.

FIG. 11 shows a cross-sectional view of the head of a doll 114 used as an enclosure for a pressure transducer 116 and an electronics assembly 122. Unlike the enclosures of FIGS. 1 and 2, the enclosure of FIG. 11 is of rigid material. Connected to the wall at its interior is the pressure transducer connected via wires 117 to the electronics assembly. The electronic assembly is, in turn, connected to a battery (not shown) through wires 120 and a speaker (not shown) through wires 118. The entire assembly acts as a petting sensor, but functions differently from the embodiments described above. In this embodiment, rubbing of the head produces vibration which is directly coupled to the pressure transducer. The electronics assembly contains the blocks shown in FIG. 3, including an amplifier/signal processor. This amplifier/signal processor is designed to select out and amplify (multiply) frequency components normally associated with movement across the surface of the enclosure, such as rubbing, stroking or petting while rejecting the frequency components normally associated with other sounds, including the sounds produced by the doll itself or vibrations. In this way, the doll can be made responsive to petting, rubbing or stroking while being immune to other types of input, including ambient sounds, hitting or dropping.

From the description above a number of other advantages of the present invention also become evident.

1. The use of a transducer in close contact with a foam or fibrous cushioning material makes a sensor especially suited to detect rubbing, petting or stroking. The movement of the foam or fibrous cushioning material produces an output signal which can be readily detected. Sound transducers, for example, normally produce output voltages of a few millivolts. However, loosely coupling a cushioning material to the surface of the pressure transducer produces a much stronger output signal, on the order of tens or even hundreds of millivolts, when cushioning material is moved. While the exact reason for the production of such a large amplitude signal is not known, it is believed to be due to the action of the cushioning material moving across the surface of the pressure transducer, essentially scratching its surface. This relatively large amplitude output means that relatively simple threshold detection circuitry can be used to distinguish between an input due to rubbing and one due to ambient sound. This makes the use of a sound transducer practical as an input transducer in this application. Though the use of an input sound transducer as a triggering mechanism is a toy that itself produces sound seems counter intuitive (since the sound produced by the toy could "jam" the input sound transducer) the system works, in part, because the pressure on the input transducer caused by the sound output transducer is small compared to the pressure changes on the surface of the input sound transducer caused by the action of the cushioning material rubbing across the surface.

2. A sensor especially designed to detect rubbing, as would occur when one object brushes past another, could find application in devices designed to monitor movement, such as alarm systems or systems which count objects as they move past some monitoring point.

3. An electronic signal such as that produced by a piezoelectric element used as a petting transducer can be readily amplified and filtered to allow better discrimination between inputs caused by rubbing or petting and those caused by dropping, bumping, shifting, tossing, or ambient noise.

4. Time delay elements can be adjusted to produce aesthetically pleasing combinations of "attack" and "decay".

5. The sensor could be used as the input device to a musical instrument whose sound output in terms of volume, pitch, frequency or other parameters would vary as the sensor was rubbed.

SUMMARY RAMIFICATIONS AND SCOPE

Accordingly, the reader will see that the elements of this invention can be used to create a toy which is responsive to rubbing, petting or stroking and produces a simulated purr as a result. It utilizes a petting transducer consisting of a pressure transducer which produces an output when cushioning material moves across or normal to its surface. Such a sensor can be made very sensitive to petting, yet relatively immune to ambient sounds, tilting or gross movements. Such a petting transducer can find applications in many devices including dolls, toys, games, therapeutic devices, motion detectors and alarms.

A simulated purring sound can be produced by the use of an asymptotically rising voltage waveform impressed across the speaker followed by an asymptotically falling waveform, wherein the rising waveform is substantially shorter in period than the falling waveform and the total frequency produced by alternate positive and negative sets of rising and falling waveforms is between 5 and 20 Hz.

A toy can also be created by mounting a pressure transducer to the surface of the toy's enclosure and detecting vibrations caused by petting. Signal processing circuitry can be used to detect frequency components associated with petting and through the use of threshold detectors, sound generators, amplifiers and speakers, produce sound effects such as a simulated purr.

Although the description above contains many specifications, these should not be construed as limiting the scope of the invention but as merely providing illustrations of some of the presently preferred embodiments of this invention. Many other variations are possible. Accordingly, the scope of the invention should be determined not by the embodiments illustrated, but by the appended claims and their legal equivalents.

I claim:

1. An amusement device comprising a pressure transducer having an output, said pressure transducer generating an electrical resultant at said output of said pressure transducer in response to change of pressure on a surface of said pressure transducer;

a pliable covering having a hardness less than said pressure transducer, said pliable covering being mechanically coupled to said pressure transducer in such a manner as to allow for the movement of at least a portion of said pliable covering across said surface of said pressure transducer;

an enclosure containing said pliable covering arranged so as to transfer movement along a surface of said enclosure to said pliable covering thereby causing movement of at least said portion of said pliable covering across said surface of said pressure transducer;

a signal processing means including an amplifying valve, an input and an output, wherein said electronic resultant produced by said pressure transducer is connected to said input of said signal processing means and thereby multiplied in amplitude by a predetermined amount producing a processed resultant and presenting said processed resultant at said output of said signal processing means;

a threshold detection means including an input connected to said output of said signal processing means, and an output, wherein an electronic trigger of predetermined form is presented at said output of said threshold detection means when said processed resultant presented at said output of said signal processing means attains a predetermined form;

a retriggerable memory having an input and an output, said input of said memory connected to said output of said threshold detection means wherein an electronic resultant of said retriggerable memory is produced at said output of said retriggerable memory which is a function of past changes in said processed resultant presented at said output of said threshold detection means;

a sound generating means including an input and an output, said input being connected to said output of said retriggerable memory, said sound generating means producing electronic signals representative of sounds at said output of said sound generating means when said electronic resultant of said retriggerable memory attains a predetermined form;

an amplification means including an input and an output, said input being connected to said output of said sound generating means, said amplification means amplifying said electronic signals representative of sounds by a predetermined amount producing a waveform and presenting said waveform at said output of said amplification means;

an output sound transducer having an input, said input of said output sound transducer being connected to said output of said amplification means, said output sound transducer producing audible sounds when said waveform produced at said output of said amplification means attains a predetermined form.

2. Amusement device of claim 1 further including a loading means inserted at said output of said pressure transducer, said loading means having the characteristic of a predetermined impedance whereby the sensitivity of said pressure transducer can be varied by varying said impedance.

3. Amusement device of claim 1 wherein said retriggerable memory is comprised of a resistor and a capacitor with one lead of said resistor connected in common with one lead of said capacitor, thereby forming a three terminal device, wherein a first terminal consists of one end of said resistor, a second terminal consists of said connection in common between said resistor and said capacitor and a third terminal consists of an end of said capacitor not connected in common with said resistor, said first and third terminals being connected to the output of said threshold detection means whereby the voltage across said capacitor is a time averaged integration of voltage across said first and third terminals.

4. Amusement device of claim 1 wherein said audible sounds are that of a purring feline.

5. A process for simulating the sound of a purring feline comprising the steps of impressing a first predetermined voltage across the terminals of a sound transducer, increasing said voltage asymptotically to a second predetermined voltage with a risetime of less than 0.1 second whereby a first rising waveform is produced, then reducing said voltage asymptotically to a third predetermined voltage with a falltime greater than said risetime of said first rising waveform but less than 0.1 second, whereby a first falling waveform is produced, then superimposing a damped ringing waveform on said first falling waveform, then reducing said voltage asymptotically to a fourth predetermined voltage with a falltime substantially equal to said risetime of said first rising waveform, whereby a second falling waveform is produced, then increasing said voltage asymptotically to a level substantially equal to said first predetermined voltage with a risetime substantially equal to the said falltime of said first falling waveform, whereby a second rising waveform is produced, then superimposing a damped ringing waveform on said second rising waveform, then repeating the aforementioned steps whereby a periodic signal is created with a total period of between 0.2 and 0.05 seconds, then decreasing the amplitude of said first rising waveform, said first falling waveform, said second falling waveform and said second rising waveform by a predetermined amount after each period, whereby sound produced by said sound transducer is observed to fade over time.

6. A process for simulating the sound of a purring feline comprising the steps of impressing a first predetermined voltage across the terminals of a sound transducer, decreasing said voltage asymptotically to a second predetermined voltage with a falltime of less than 0.1 second whereby a first falling waveform is produced, then increasing said voltage asymptotically to a third predetermined voltage with a risetime greater than said falltime of said first falling voltage waveform but less than 0.1 second, whereby a first rising waveform is produced, then superimposing a damped ringing waveform on said first rising waveform, then increasing said voltage asymptotically to a fourth predetermined voltage with a risetime substantially equal to said falltime of said first falling waveform, whereby a second rising waveform is produced, then decreasing said voltage asymptotically to a level substantially equal to said first predetermined voltage with a falltime substantially equal to the said risetime of said first rising waveform, whereby a second falling waveform is produced, then superimposing a damped ringing waveform on said second falling waveform, then repeating the aforementioned steps whereby a periodic signal is created with a total period of between 0.2 and 0.05 seconds, then decreasing the amplitude of said first falling waveform, said first rising waveform, said second rising waveform and said second falling waveform by a predetermined amount after each period, whereby sound produced by said sound transducer is observed to fade over time.

* * * * *